United States Patent [19]

Cycowicz et al.

[11] 3,952,344

[45] Apr. 27, 1976

[54] PULL-OUT FOLDING SOFA BEDS

[75] Inventors: Izchak Cycowicz, Brooklyn, N.Y.; John Wong, Jersey City, N.J.

[73] Assignee: Mohasco Corporation, Amsterdam, N.Y.

[22] Filed: Apr. 16, 1975

[21] Appl. No.: 568,714

[52] U.S. Cl. ..... 5/186 R; 5/13; 5/35; 5/51 H

[51] Int. Cl.[2] ..... A47C 17/14

[58] Field of Search ..... 5/13, 15, 18, 35, 42, 5/51 E, 51 H, 247, 255, 132, 186

[56] References Cited

UNITED STATES PATENTS

| | | | |
|---|---|---|---|
| 3,056,974 | 10/1962 | McKay | 5/247 |
| 3,431,567 | 3/1969 | Spitz et al. | 5/13 |
| 3,854,153 | 12/1974 | Fadler et al. | 5/13 |

*Primary Examiner*—Casmir A. Nunberg
*Attorney, Agent, or Firm*—J. B. Felshin

[57] ABSTRACT

This bed comprises a front forwardly extending foot section having rearwardly extending side arms. Said side arms have similar, symmetrically disposed, horizontal offset portions raised above the horizontal plane of the bed mattress supporting fabric of the bed platform when the bed is in open sleeping position. In the closed position of the bed, the foot section projects rearwardly and said offset portions are then disposed below the horizontal plane of the mattress supporting fabric and hence in a depressed plane. The fabric is connected to each of a pair of zig-zag springs disposed alongside said depressed portions (in the closed position of the bed), at points disposed inwardly of the ends of the zig-zag springs, and also by a pair of helical tension springs to the side arms, at locations beyond the outer ends of said depressed portions. With such construction, persons sitting at the ends of the sofa (when the bed is closed) have a softer, more comfortable seat, because of the depressed side portions of the foot section and because of less tension on the fabric, and also more relaxing, softer seating between the ends of the sofa, because of use of less helicals to connect the fabric to the bed frame at the sides of said foot section. The ends of the zig-zag springs are furthermore received in the end helical springs on each side of the foot section to house and encase said ends.

13 Claims, 4 Drawing Figures

11
12
17a
10
17b
17
17e
13
16
14
15

20
17a
20d
20e
33
34
17f
17b
17h
47
46
41
17e
17
20c
45
40
20b
45
46
47
17c
31
17g
30
20b
20c
20d
20e
20a
20c
25
17a
17e
17
16
15
13
14

PULL-OUT FOLDING SOFA BEDS

This invention relates to pull-out folding sofa beds.

One object of this invention is to provide a bed having a foot section which is softer and more resilient at the sides thereof, when the bed is in folded or closed position, for use as a sofa.

In prior constructions the mattress supporting fabric has been connected to the side portions of the foot section of the folding bed, by a relatively large number of helical springs, (such as eight helicals). Furthermore the side portions of the foot section heretofore were in the plane of the mattress supporting fabric. Such prior constructions often made it uncomfortable to sit on the sofa near the side arms of the sofa frame, or even therebetween, because there was too much tension on the mattress supporting fabric, and the side portions of the foot section were at the level of the foot section frame.

In the sofa or folded or closed position of the prior beds, the foot section being at the top and projecting rearwardly, the straight side portions of the foot section produced a hard undersupport for the sofa pillows. It is hence another object of this invention to overcome this difficulty by providing a highly improved pull-out sofa bed construction in which the side portions of the foot section are raised or upwardly offset between the ends thereof, above the plane of the mattress supporting fabric, in the open, sleeping position of the bed, so that in the closed or folded position of the bed, the foot section projects rearwardly and disposed above the folded mattress. In such position said offset portions are depressed, to thereby provide a softer support for the sofa pillows. The mattress supporting fabric is attached by helical tension springs to portions of zig-zag springs, inwardly of the ends thereof, and said fabric is connected by helical tension springs to the side portions of the foot section at opposite ends of said depressed portions.

Still another object of this invention is to provide in a bed of the character described, a mattress supporting fabric which is connected to each side of foot section frame only by a pair of helical or coil tension springs instead of by more helical springs, as is common in prior constructions.

A further object of this invention is to provide a bed of the character described, in which the end arms of the zig-zag springs are received in the helical tension springs which attach the mattress supporting fabric to the side arms of the foot section, to house and encase said end arms.

Yet a further object of this invention is to provide a strong, rugged and durable bed construction of the character described which shall be relatively inexpensive to manufacture, easy to assemble, comfortable in use and which shall yet be practical and efficient to a high degree.

Other objects of this invention will in part be obvious and in part hereinafter pointed out.

The invention accordingly consists in the features of construction, combinations of elements, and arrangement of parts which will be exemplified in the construction hereinafter described and of which the scope of invention will be indicated in the following claims.

Figure 1:
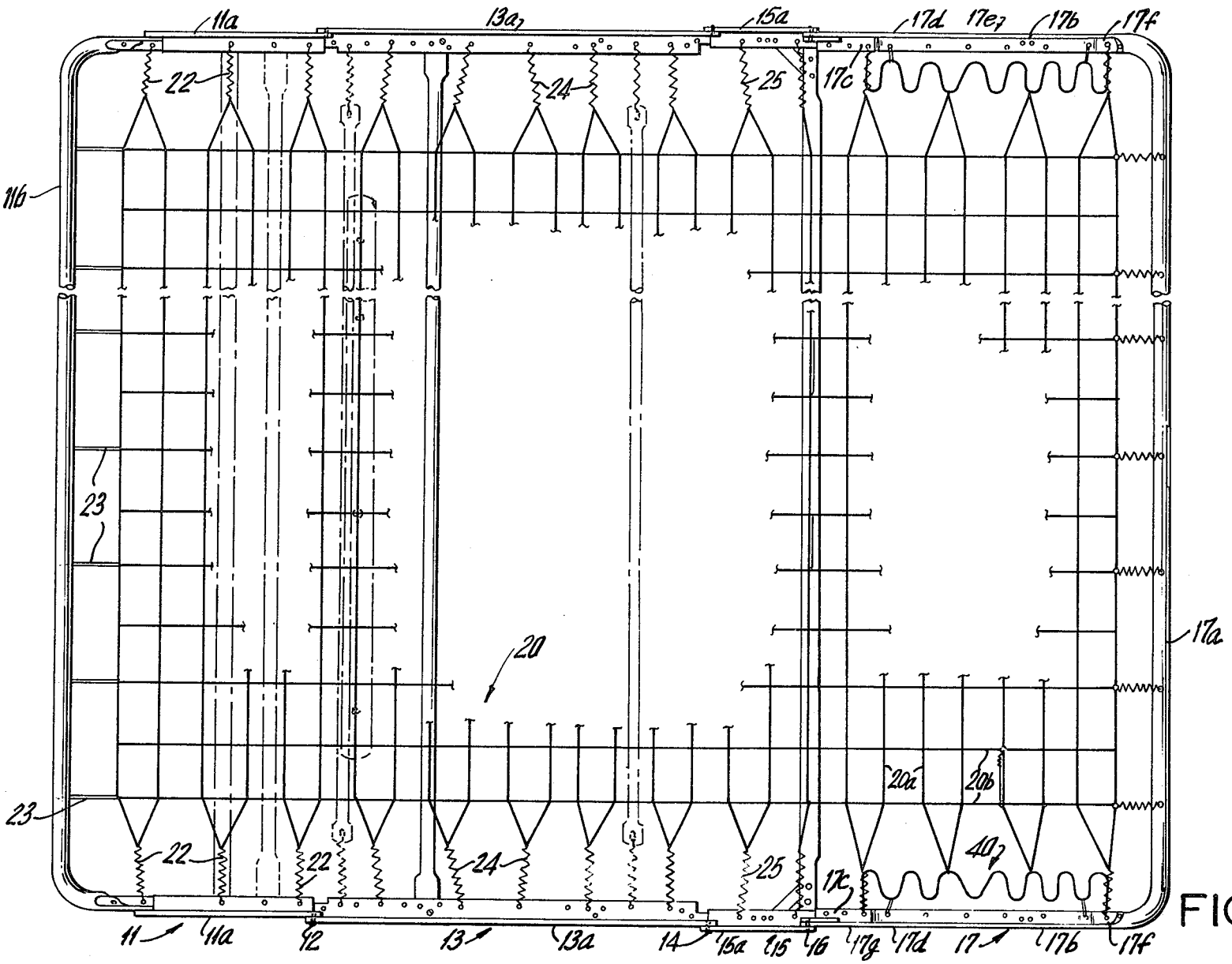
FIG. 1 is a top plan view of a folding bed mattress supporting platform for a pull-out sofa bed, embodying the invention.

Referring now in detail to the drawing, 10 designates a mattress supporting platform embodying the invention. This platform is part of a folding pull-out sofa bed in which the platform, when in open or sleeping position is extended in a horizontal plane and is attached by leverage (not shown) to a sofa bed wood frame (not shown), in the well known manner. Said bed platform 10 comprises a rear head section 11 pivoted as at 12 to a first or intermediate long section 13 which in turn is pivoted as at 14 to a short or second intermediate section 15 pivoted as at 16 to a front foot section 17. This platform is provided with front and rear legs (not shown), but of usual, well known construction. The invention herein, as will appear hereinafter, resides in the construction of the foot section and its connection to the mattress supporting fabric 20.

The head section 11 may be of usual construction and comprises a pair of parallel, similar, symmetrical side arms or angles 11*a* interconnected by a rear cross-tube 11*b* and is connected to mattress supporting fabric 20 of usual construction except as described hereinafter, and including linkage connected to the side angles 11*a* by coil or helical tension springs 22, and by links 23, to the cross member 11*b*.

The first or long intermediate section 13 comprises parallel, symmetrically disposed side angles 13*a* connected to part of the fabric 20 by coil or helical springs 24. The short or second intermediate section 15 comprises short similar, symmetrical side angles 15*a* connected to the fabric by helical tension springs 25.

The foot section 17 may be made of tubular stock and comprises a front cross-tube 17*a* from which similar, symmetrical side arms 17*b* extend rearwardly, when the bed is in the open, sleeping position of FIG. 1.

Said side arms 17*b* may be of tubular stock, die pressed into angular shape to have bottom inwardly extending flanges 17*c* and outer, upwardly extending vertical flanges 17*d*, when the bed is in the open sleeping position of FIG. 1.

In prior constructions, said arms 17*b* were straight. Also said straight side arms of prior constructions were usually each attached directly to the mattress supporting fabric by many helical tension springs.

Figures 2, 3, 4:
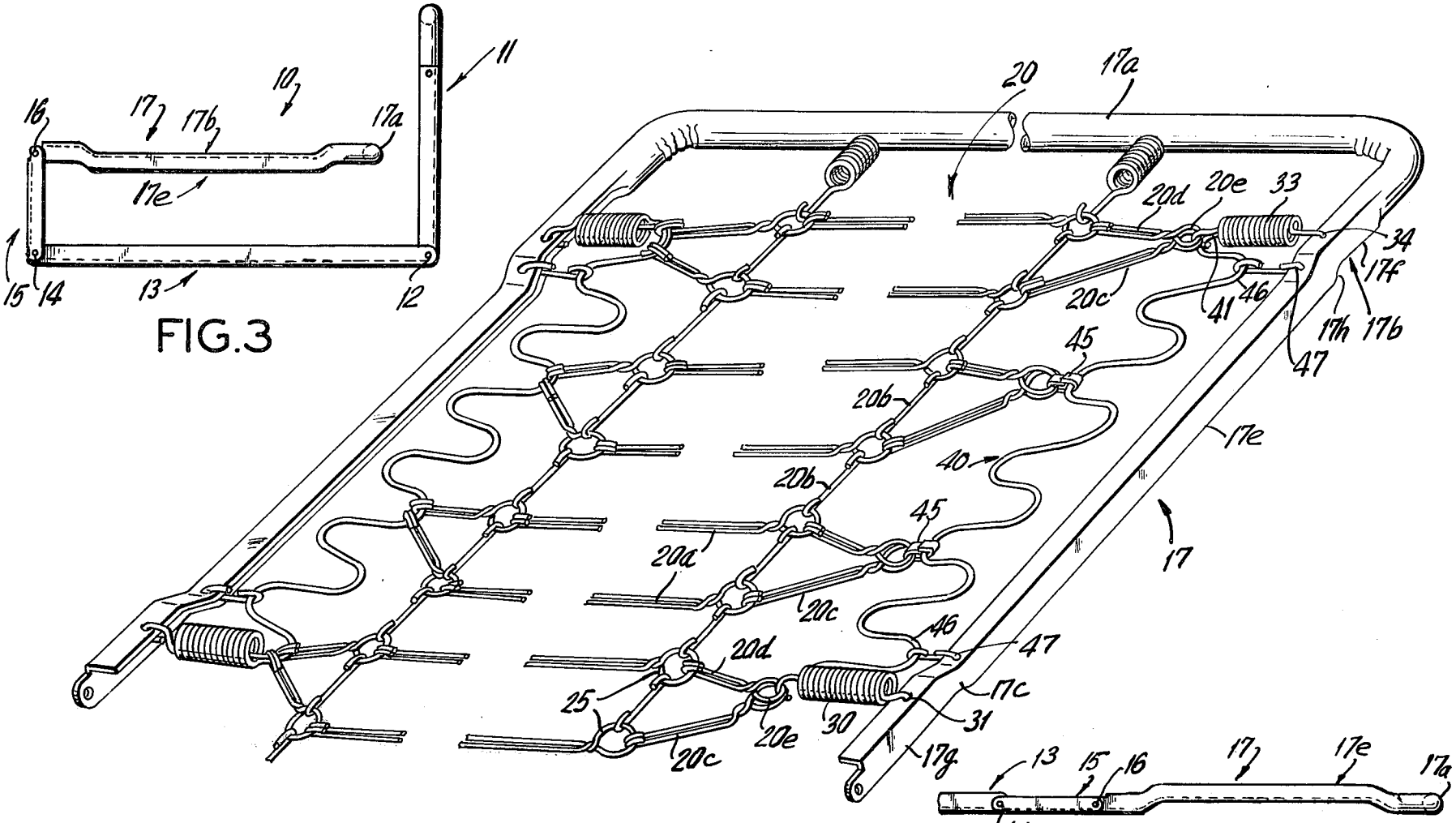
FIG. 2 is a perspective view of the foot section of such bed, with parts broken away.
FIG. 3 is a side elevational view of the platform in folded condition.
FIG. 4 is a partial side elevational view of the rear end of the platform shown in FIG. 1.

In the folded or collapsed sofa position of the folding bed, as shown in FIG. 3, the long intermediate section 13 is at the bottom, the rear head section projects up from the rear end of said long intermediate section; the short intermediate section 15 projects vertically upwardly from the front end of the long intermediate section 13, and the foot section 17 projects rearwardly from the upper end of the short intermediate section and overlies the long intermediate section 13, in vertically spaced relation thereabove. The usual mattress (not shown) is at least partially disposed between sections 13 and 17 when the bed is folded.

The sofa pillows (not shown) are placed on top of the rearwardly extending foot section 17, when the bed is fully collapsed in sofa position.

Since in prior constructions, the side arms of the foot section were straight (and horizontal), persons sitting at the ends of the sofa, near the side arms of the sofa wood frame, had hard seats that are not comfortable.

Also since the mattress supporting fabric was usually attached directly to each of the straight side arms of prior sofa bed construction by a larger number of helicals, there was too much tension on the mattress supporting fabric, which often resulted in a hard support for persons sitting at the middle, as well as at the ends, of the sofa. To overcome this difficulty, portions 17*e* of the side arms 17*b* of the foot section herein, are raised, between the ends of said side arms, (in the sleeping, open or extended position of the bed) as shown in FIGS. 1 and 4 of the drawing. The raised portions 17*e* are major lengths of the side arms. Said side arms have rear end portions 17*f* adjacent the cross bar 17*a*, and front end portions 179 adjacent the pivots 16 (when the bed is in open, sleeping position).

Thus the portions 17*e* are longer than the portions 17*f* and 17*g*. Between portions 17*e* and portions 17*f* are shoulders 17*h*. Between portions 17*e* and portions 17*g* are shoulders 17*i*.

The mattress supporting fabric 20 includes transverse links 20*a* hooked or connected to longitudinal links 20*b* in usual manner. At the junctions of the transverse links 20*a*, with the end rows of longitudinal links 20*b* are loops 25 connected by converging links 20*c*, 20*d* joined at apex loops 20 *e* and forming triangles, as shown in the drawing.

A helical tension spring 30 is hooked at one end to a hole 31 in portion 17*g* and at its other end to loops 20*e* at the junction of links 20*c*, 20*d*. A second helical tension spring 33 is hooked at one end in a hole 34 in portion 17*f* and at its other end to similar loops 20*e* of another triangle of links, similar to links 20*c*, 20 *d*.

At the inner side of the raised portions 17*e* of each side arm is a zig-zag spring 40 having end arms 41 received in helical or coil springs 30, 33. A pair of triangles 20*b*, 20*c*, 20 *d* similar to the aforementioned pair of triangles, and disposed therebetween have their apeces attached by clips 45 to inwardly extending bends in the zig-zag spring 40 located inwardly of the outer end arms of the zig-zag spring. A pair of outwardly extending bends 46 of said zig-zag springs 40 are connected by clips 47 to ends of portions 17*e* of the side arms 17*b* of the foot section. The bends 46 are located just inwardly of the helicals 30, 33.

In the sofa position of the bed, when the bed is fully folded, as shown in FIG. 3, the portions 17*e* of arms 17*b* are depressed below cross bar 17*a* and ends 17*f*, 17*g* of the side arms 17*b*. Thus, when pillows are placed on the foot section of the folded bed, a person sitting on the sofa pillows will be able to sink lower than he could have done if the side arms 17*b* were straight, thereby allowing for a softer seat.

Also the fact that the mattress supporting fabric is attached directly to each of the side arms by only two helical springs instead of a larger number provides for a more resilient, more flexible, more relaxed seat throughout the length of the sofa. The zig-zag springs 40 provide soft edges at the ends of the foot section, for the purpose of creating softer, more depressible seats when the bed is in use as a sofa.

It will thus be seen that there is provided a device in which the several objects of this invention are achieved and which is well adapted to meet the conditions of practical use.

As various possible embodiments might be made of the above invention, and as various changes might be made in the embodiment above set forth, it is to be understood that all matter herein set forth or shown in the accompanying drawings is to be interpreted as illustrative.

We claim:

1. A folding, pull-out sofa-bed comprising a plurality of interpivoted bed sections including a front foot section projecting forwardly in the open, sleeping position of said bed, said foot section comprising a frame member having a front cross bar and side arms extending rearwardly therefrom, in said open, sleeping position of said bed, said side arms having vertically, upwardly offset portions in said open, sleeping position of said bed, mattress supporting fabric and means to attach said fabric to said sections of said bed, said offset portions being vertically offset, downwardly in the fully folded position of said bed, zig-zag springs at the inner sides of said side arms, and extending longitudinally of and longside of the offset portions of said side arms, and means to attach said zig-zag springs adjacent outer ends thereof, to the respective side arms, and means to attach said zig-zag springs to said mattress supporting fabric between the outer ends of said offset portions, said zig-zag springs each having inwardly projecting bends, and outwardly projecting bends.

2. The combination of claim 1, said offset portions of said side arms being disposed between and short of the ends of said sidearms.

3. The combination of claim 1, said means to attach said fabric to said sections of said bed, including pairs of coil tension springs attaching said fabric to said side arms of the foot section at opposite ends of said offset portions.

4. The combination of claim 3, the attachment of said fabric to said zig-zag springs, comprising means interconnecting said fabric to inwardly projecting bends of said zig-zag springs.

5. The combination of claim 4, the means for attaching said zig-zag springs to said side arms comprising means attaching outwardly projecting bends of said zig-zag springs to said side arms.

6. The combination of claim 1, said means to attach said fabric to said sections of said bed, including pairs of coil tension springs attaching said fabric to said side arms of the foot section at opposite ends of said offset portions, each of said zig-zag springs having end arms received in a pair of said coil springs.

7. A folding, pull-out sofa-bed comprising a plurality of interpivoted bed sections including a front foot section projecting forwardly in the open, sleeping position of said bed, said foot section comprising a frame member having a front cross bar and side arms extending rearwardly therefrom, in said open, sleeping position of said bed, said side arms having vertically, upwardly offset portions in said open, sleeping position of said bed, mattress supporting fabric and means to attach said fabric to said sections of said bed, said offset portions being vertically offset, downwardly in the fully folded position of said bed, zig-zag springs at the inner sides of said side arms, means to attach said zig-zag springs to the respective side arms, and means to attach said zig-zag springs to said mattress supporting fabric, said zig-zag springs each having inwardly projecting bends, and outwardly projecting bends, said means to attach said fabric to said sections of said bed, including pairs of coil tension springs attaching said fabric to said side arms of the foot section at opposite ends of said offset portions, the attachment of said fabric to said zig-zag springs, comprising means interconnecting said fabric to inwardly projecting bends of said zig-zag springs, the means for attaching said zig-zag springs to said side arms comprising means attaching outwardly projecting bends of said zig-zag springs to said side arms, the means for attaching said outwardly projecting bends to said side arms being located between the means for attaching said fabric to said inwardly projecting bends, and said pair of coil tension springs which attach said fabric to said side arms of said foot section.

8. The combination of claim 7, the means for attaching said outwardly projecting bends to said side arms, being attached to offset portions of said side arms.

9. The combination of claim 8, said offset portions of said side arms being disposed between and short of the ends of said sidearms, the coil springs which attach said fabric to said side arms, being attached to end portions of said side arms.

10. A folding, pull-out sofa-bed comprising a plurality of interpivoted bed sections including a front foot section projecting forwardly in the open, sleeping position of said bed, said foot section comprising a frame member having a front cross bar and side arms extending rearwardly therefrom, in said open, sleeping position of said bed, said side arms having vertically, upwardly offset portions in said open, sleeping position of said bed, mattress supporting fabric and means to attach said fabric to said sections of said bed, said offset portions being vertically offset, downwardly in the fully folded position of said bed, said offset portions of said side arms being disposed between and short of the ends of said side arms, zig-zag springs at the inner sides of said side arms, means to attach said zig-zag springs to the respective side arms, and means to attach said zig-zag springs to said mattress supporting fabric, said zig-zag springs each having inwardly projecting bends, and outwardly projecting bends.

11. The combination of claim 10, said means to attach said fabric to said sections of said bed, including pairs of coil tension springs attaching said fabric to said side arms of the foot section at opposite ends of said offset portions.

12. The combination of claim 11, the attachment of said fabric to said zig-zag springs, comprising means interconnecting said fabric to inwardly projecting bends of said zig-zag springs.

13. The combination of claim 1, said offset portions of said side arms comprising major lengths of said side arms.

* * * * *